US005314232A

United States Patent [19]

Hopkins

[11] Patent Number: 5,314,232

[45] Date of Patent: May 24, 1994

[54] HIGH CHAIR POUCH

[76] Inventor: David Hopkins, 19411 Old Homestead, Harper Woods, Mich. 48225

[21] Appl. No.: 52,593

[22] Filed: Apr. 22, 1993

[51] Int. Cl.[5] ..... A47C 7/62

[52] U.S. Cl. ..... 297/191; 206/553; 248/205.2; 383/11; 383/40

[58] Field of Search ..... 297/188, 191, 148, 153; 108/149; 383/11, 38, 40; 248/102, 205.2, 205.3; 206/553

[56] References Cited

U.S. PATENT DOCUMENTS

| | | | |
|---|---|---|---|
| 664,287 | 12/1900 | Pettibone | 206/553 |
| 1,416,238 | 5/1922 | Seiler | 383/38 |
| 2,724,429 | 11/1955 | Warner | 297/191 X |
| 2,761,481 | 9/1956 | Boatwright | 383/40 X |
| 4,240,480 | 12/1980 | Strobel | 383/40 X |
| 4,418,733 | 12/1983 | Kallman | 383/11 |
| 4,548,375 | 10/1985 | Moss | 248/205.2 |
| 4,896,027 | 1/1990 | Drexler | 206/461 X |

*Primary Examiner*—Bryon P. Gehman
*Attorney, Agent, or Firm*—Dykema Gossett

[57] ABSTRACT

A high chair pouch having various article containment members and adapted to be removably mounted on the back of a high chair by use of mating members.

5 Claims, 2 Drawing Sheets

HIGH CHAIR POUCH

FIELD OF THE INVENTION

This invention relates to a pouch and more particularly, to a pouch which may be removably secured to the back of a high chair. The pouch, in one embodiment, provides a housing for utensils such as spoons, forks and a drinking cup for the infant to use. All attachments are mounted externally to the pouch for convenience of use.

BACKGROUND OF THE INVENTION

Babies are normally placed in high chairs in order to allow those individuals attending to the baby to feed the baby in an efficient and clean manner. During such feeding, many types of utensils, such as knives, spoons, cups, and other materials such as tissues are needed. These materials are normally scattered in various places around the high chair making the feeding rather difficult and messy.

There is therefore a need to provide a means for organizing and storing baby feeding materials in close proximity to a high chair.

SUMMARY OF THE INVENTION

According to one aspect of the present invention a pouch is provided.

According to a second aspect of the present invention a pouch is provided for use on the back of a high chair and is adapted to contain utensils and other materials which are used to feed a baby.

According to one aspect of the present invention a high chair pouch is provided. The pouch includes velcro means for removably attaching the pouch to the high chair; and containment means for receivably containing a fork, spoon, cup, and tissues.

These and other features, object, and advantages of the present invention will become apparent from a reading of the following detailed description of the preferred embodiment and by reference to the claims taken in combination with the accompanying drawings.

DETAILED DESCRIPTION OF THE PREFERRED EMBODIMENT

Figure 1:
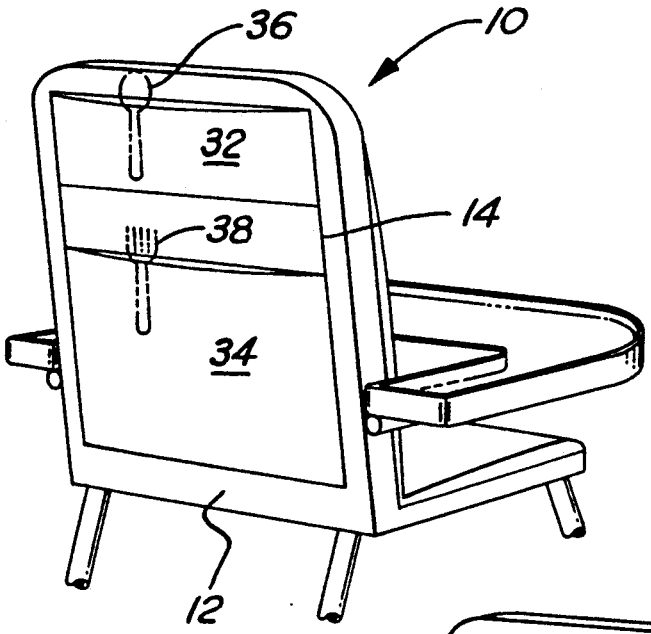
FIG. 1 is a partial perspective view of the pouch of the preferred embodiment of this invention shown in assembled relation upon the back of a conventional high chair.
Figure 2:
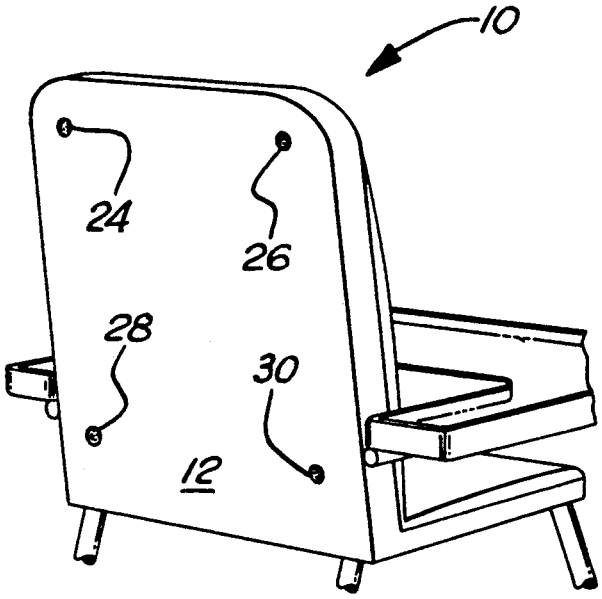
FIG. 2 is a partial perspective view of the back of the high chair shown in FIG. 1, and illustrating the use of attachment means for attaching the pouch to the high chair.
Figure 3:
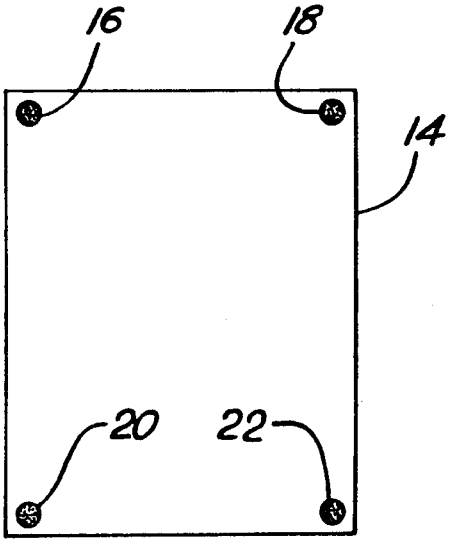
FIG. 3 is a back view of the pouch shown in FIG. 1.

Referring now to FIGS. 1–3 there is shown a high chair 10 having a back portion 12 upon which a pouch 14, made in accordance with the teachings of this invention, is provided.

As shown best in FIGS. 2 and 3, pouch 14 includes mounting members 16, 18, 20, and 22 which are attached to the back of pouch 14 and which cooperate with mounting members 24, 26, 28, and 30 to mount pouch 14 upon the back of high chair 10. Alternatively, strip mounting members 23,25 may be used and cooperate with substantially similar strips (not shown) on the back of high chair 10 to mount pouch 12. Specifically, members 18, 22, 20, and 16 are respectively and uniquely attached to respective members 24, 28, 26, and 30 and allow pouch 14 to be removed from back portion 12 in order to be cleaned, repaired, and/or stored. Members 16–22, 24–30 and 23–25 may comprise mounting material marketed under the VELCRO® trademark.

Figure 4:
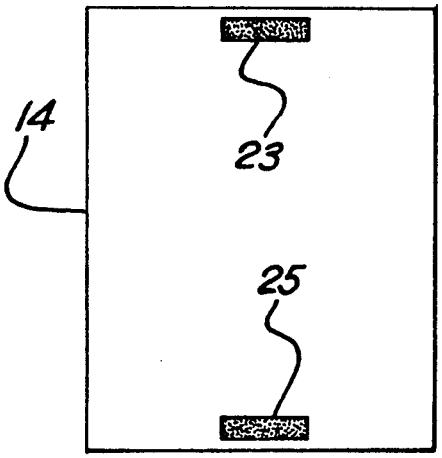
FIG. 4 is a view similar to FIG. 2 but illustrating alternate attachment means.
Figure 5:
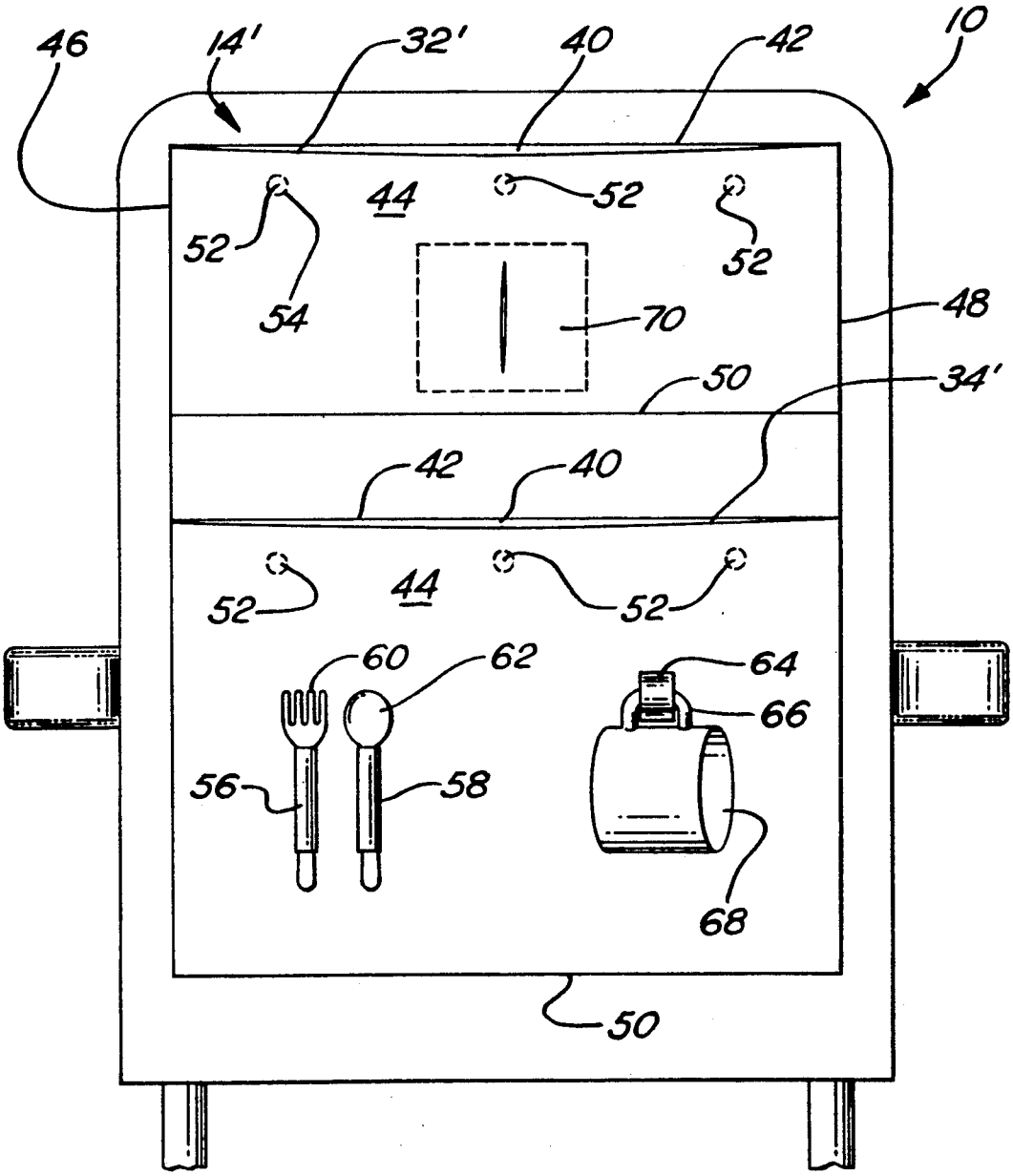
FIG. 5 is a front view of a pouch made in accordance with an alternate embodiment of this invention.

In a first pouch embodiment shown in FIG. 1, pouch 14 includes two containment sections 32, 34 into which utensils 36, 38 (shown in phantom) may be placed. In a second pouch embodiment, shown in FIG. 4, pouch 14' includes containment members 32' and 34'. As shown, each containment member 32', 34' includes an access opening 40 which is defined by first and second flaps 42 and 44 which are joined along the sides 46, 48 and bottom portion 50. Each flap 42, 44 includes members 52 and 54 which cooperate to allow opening 40 to be selectively closed when flaps 42 and 44 are joined along each of the members 52, 54. Members 52, 54 may comprise mounting material marketed under the VELCRO® trademark.

As further shown, lower pouch member 34' includes a pair of substantially similar and generally cylindrical members 56, 58 having open ends and a diameter which is slightly larger than the diameter of a conventional baby's spoon and fork and which are adapted to removably mount fork 16 and spoon 62 to the outer surface of pouch 34'. Moreover, pouch 34' further includes a generally cylindrical mounting member 64 having a diameter which is slightly larger than the diameter of a conventional handle of a baby's cup 66 and having open ends. Member 64 is adapted to removably secure cup 68 to the outer surface of pouch 34'. Therefore, pouches 32' and 34' may be used to secure items such as tissues 70 and may also be adapted to allow articles 60, 62, and 68 to be removably mounted upon the outer surface of pouch 14'. It should therefore be obvious to one of ordinary skill in the art that pouches 14 and 14' allow for the efficient storage of articles needed to feed a baby while the baby resides in high chair 10 and further allows such feeding to be done in a rather clean manner.

It is to be understood that the invention is not limited to the exact construction or method illustrated and described above, but that various changes and modifications may be made without departing from the spirit and scope of the invention as set forth in the following claims.

I claim:

1. A high chair pouch for use in combination with a high chair, said pouch comprising:

a generally rectangular body which is removably mounted to the back of a high chair;

a first hollow cylindrical member mounted upon said body and having open ends which allow said first cylindrical member to removably receive a first utensil and to vertically mount a received first utensil on said body;

a second hollow cylindrical member mounted upon said body and having open ends which allow said second cylindrical member to removably receive a second utensil and to vertically mount a received second utensil on said body; and first and second flap means for providing a first storage cavity into which various articles may be placed.

2. The high chair pouch of claim 1 wherein said first utensil comprises a spoon.

3. The high chair pouch of claim 1 wherein said second utensil comprises a knife.

4. The high chair pouch of claim 1 further comprises a third hollow cylindrical member mounted upon said body and having open ends which allow said third cylindrical member to removably receive a third utensil and to horizontally mount a received third utensil on said body.

5. The high chair pouch of claim 4 wherein said third utensil comprises a cup.

* * * * *